US005181351A

United States Patent [19]

Jaecklin

[11] Patent Number: 5,181,351

[45] **Date of Patent: * Jan. 26, 1993**

[54] BUILDING ELEMENT FOR SUPPOTING GRID WALLS WITH A BULK MATERIAL FILLING

[76] Inventor: Felix P. Jaecklin, Geissbergstrasse 46, CH-5400 Ennetbaden, Switzerland

[ * ] Notice: The portion of the term of this patent subsequent to May 21, 2008 has been disclaimed.

[21] Appl. No.: 699,882

[22] Filed: May 14, 1991

Related U.S. Application Data

[60] Division of Ser. No. 24,846, Mar. 18, 1987, Pat. No. 5,017,050, which is a continuation of Ser. No. 721,858, Apr. 9, 1985, abandoned.

[30] Foreign Application Priority Data

Apr. 10, 1984 [DE] Fed. Rep. of Germany ..... 3413479

[51] Int. Cl.[5] ..... E04C 1/39; E02D 17/02; E02D 29/02; C10J 3/02

[52] U.S. Cl. ..... 52/35; 52/169.1; 52/608; 405/285; 47/83

[58] Field of Search ..... 52/608, 169.1, 610, 52/35; 47/83; 405/284–286

[56] References Cited

U.S. PATENT DOCUMENTS

| | | | |
|---|---|---|---|
| 2,419,996 | 5/1947 | Honikman | 52/12 |
| 4,384,810 | 5/1983 | Neumann | 405/284 |
| 4,524,551 | 6/1985 | Scheiwiller | 52/608 |
| 5,017,050 | 5/1991 | Jaecklin | 405/284 |

FOREIGN PATENT DOCUMENTS

| | | | |
|---|---|---|---|
| 0016353 | 10/1980 | European Pat. Off. | 47/83 |
| 0031154 | 1/1981 | European Pat. Off. | 52/169.1 |

*Primary Examiner*—James L. Ridgill, Jr.
*Attorney, Agent, or Firm*—Tarolli, Sundheim & Covell

[57] ABSTRACT

A bulk material supporting wall comprises at least two beams arranged at an angle to one another and connected in a form-locking or material-locking manner. One beam is a longitudinal beam extending substantially parallel to the wall plane and the other is a cross beam extending at an angle to the longitudinal beam. The first beam comprises at least two profile legs arranged at an angle to one another. The first profile leg forms a bulk material bearing surface which covers the central part of the longitudinal beam's cross section. The second profile leg forms a bulk material retaining surface which faces the inside space of the frame and is arranged offset to the outside of the frame with respect to the bearing surface and at an angle to the bearing surface. The first profile leg has a wedge-shaped cross-section and a substantially plane bottom surface forming the underside of the wedge-like cross-section. The bearing surface which forms the upper side of the first profile leg is also of substantially plane shape such that the cross-sectional height of the first profile leg increases evenly from the outside inwards. This design combines enhanced internal stability of the wall against force and bending moments exerted by the bulk material filling.

13 Claims, 10 Drawing Sheets

BUILDING ELEMENT FOR SUPPOTING GRID WALLS WITH A BULK MATERIAL FILLING

RELATED APPLICATIONS

This application is a divisional application of co-pending application Ser. No. 024,846, Filed Mar. 18, 1987 (Now U.S. Pat. No. 5,017,050, Issued May 21, 1991), which is a continuation of co-pending application Ser. No. 721,858, Filed Apr. 9, 1985, now abandoned.

The invention relates to building elements for supporting grid walls with a bulk material filling. These are particularly frame-like elements comprising at least two sub-elements, preferably in the form of beams arranged at an angle to one another, and connected in a form-locking or material-locking manner. Especially in the case of such sub-elements being connected in a form-locking manner the element may be regarded also as a building element kit from which one or more complete elements can be assembled, particularly in situ. Accordingly the term "building element" is intended to comprise unitary elements as well as multi-part and more complex elements.

In many cases one of sub-elements or beams is constructed as a longitudinal beam extending substantially parallel to the wall plane and comprising at least two profile legs arranged at an angle to one another. The first of these profile are forming at least one bearing surface for the bulk material filling, which bearing surface covers substantially the central part of the longitudinal beam's cross-section, while the second of these profile legs forms a retaining surface for the bulk material filling facing the inside space of the frame and being offset to the outside of the frame with respect to the bearing surface for the bulk material filling as well as being arranged at an angle thereto.

Such building elements are known in the art from the German patent specifications laid open to public inspection Nos. 31 03 849, 31 06 486 and 24 20 173. These building elements are all in need of improvement with regard to the combination of their carrying capacity and their bond strength in relation to mass and construction cost, as well as with regard to their retaining and securing ability with respect to the bulk material filling.

According to a first aspect of the invention, there is provided a frame-shaped building element for supporting grid walls with a bulk material filling, comprising at least two beams arranged at an angle to one another, and connected in a form-locking or material-locking manner, one of which is constructed as a longitudinal beam extending substantially parallel to the wall plane and comprising at least two profile legs arranged at an angle to one another, the first of these profile legs forming at least one bearing surface for the bulk material filling covering substantially the central part of the longitudinal beam's cross-section, and the second of these profile legs forming a retaining surface for the bulk material filling facing the inside space of the frame, offset to the outside of the frame with respect to the bearing surface for the bulk material filling, and arranged at an angle, characterised in that the first profile leg has a wedge-shaped cross-section with a cross-sectional height which increases evenly from the out-side inwards.

Another aspect of the invention provides a frame-shaped building element for supporting grid walls with a bulk material filling, comprising at least two beams arranged at an angle to one another, and connected in a form-locking or material-locking manner, one of the beams being constructed as a longitudinal beam extending substantially parallel to the wall plane and comprising at least two profile legs arranged at an angle to one another, wherein the first of these profile legs forms at least one bearing surface for the bulk material filling, characterised in that the second profile leg is arranged offset towards the inside of the frame and extends from this bearing surface upwardly, and comprises at least one retaining surface for the bulk material filling facing away from the inside space of the frame and extending upwardly therefrom at an angle.

A further aspect of the invention provides a building element for supporting grid walls with a bulk material filling, designed as a profile beam comprising at least two profile legs, arranged at an angle to one another, the first of which has at least one bearing surface for the bulk material filling and the second at least one retaining surface for the bulk material filling arranged at an angle to the bearing surface for the bulk material filling, characterised in that the first profile leg has a triangular cross-section with a cross-sectional height which increases evenly from the point where it is joined to the second profile leg.

Yet another aspect of the invention provides a building element for supporting grid walls with a bulk material filling, constructed as a profile beam with at least two profile legs arranged at an angle to one another, the first of which legs comprises at least one bearing surface for the bulk material and the second at least one retaining surface for the bulk material filling arranged at an angle to the bearing surface for the bulk material filling, according to any one of claims 24 to 29, characterised in that the second profile leg has a wedge-shaped or triangular cross-section with a cross-sectional width which increases from the point where it is joined to the first profile leg.

Another aspect of the invention provides a building element for supporting grid walls with a bulk material filling, constructed as a profile beam comprising at least one surface provided for bearing, retaining or supporting the bulk material filling, characterised by at least three profile legs or profile leg sections, angled alternately in opposite directions to one another around the longitudinal axis of the beam.

A further aspect of the invention provides a building element for supporting grid walls with a bulk material filling, constructed as a profile beam comprising a plurality of profile legs arranged at an angle to one another, characterised by at least one T-shaped or cross-shaped profile section with at least one pair of at least approximately aligned profile legs.

A still further aspect of the invention provides a building element for supporting grid walls with a bulk material filling, constructed as a profile beam comprising a plurality of profile legs arranged at an angle to one another, of which at least a first one forms a bearing surface for the bulk material filling, characterised by at least one second profile leg which is formed onto the first profile leg parallel to its longitudinal direction and at a distance from the two longitudinal end edges thereof.

Another aspect of the invention provides a building element for supporting grid walls with a bulk material filling, constructed as a profile beam with at least one bearing surface for the bulk material, characterised in that the cross-sectional height of the profile beam measured transversely to the bearing surface for the bulk material filling, at least over the central part of the cross-sectional width, increases from the two outsides towards the middle.

Yet another aspect of the invention provides a building element for supporting grid walls with a bulk material filling, constructed as a profile beam with at least one bearing surface for the bulk material filling, characterised by at least two bearing surfaces for the bulk material filling arranged at an obtuse angle to one another.

Embodiments of the invention will now be described with reference to the accompanying drawings.

Figure 1:
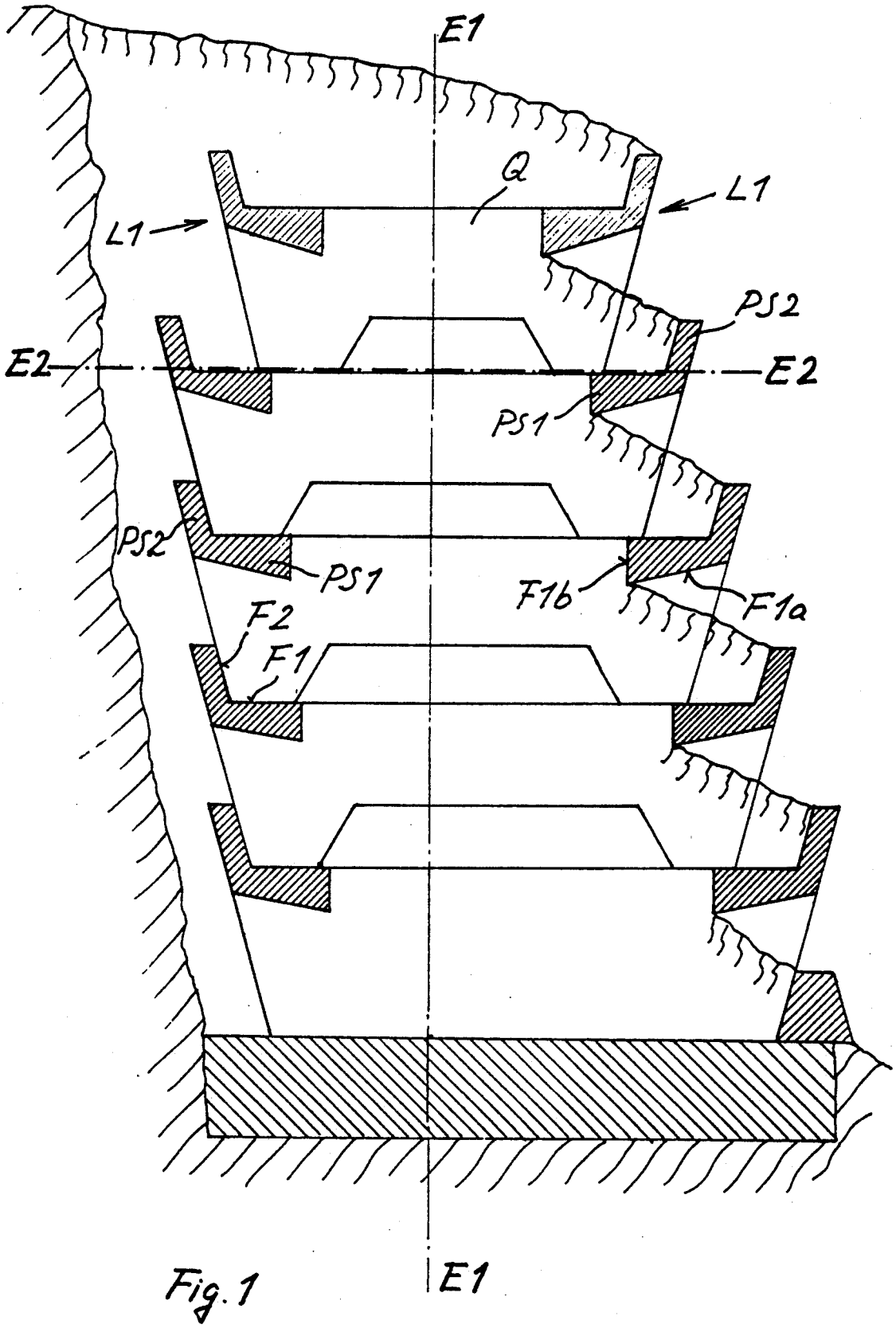
FIG. 1 shows a vertical cross-sectional view of a slope supporting grid wall with bulk material filling.

The supporting grid wall according to FIG. 1 serves as a slope retaining wall and consists of frame-shaped building elements placed on top of one another. Each consists of two front and rear longitudinal beams L1 and at least one cross beam Q. The longitudinal and cross beams are arranged in the usual manner at an angle to one another, preferably at right angles, and are made, for example, in one piece from concrete, thus establishing a material locking connection. A suitable form-locking connection between the longitudinal and cross beams may also be considered, for example by means of bolting or clamping the beams together or by means of coactive teethed elements in a known manner. A specifically advantageous tooth-like connection TLC between longitudinal and cross beam is shown in FIG. 1A.

Figure 1A:
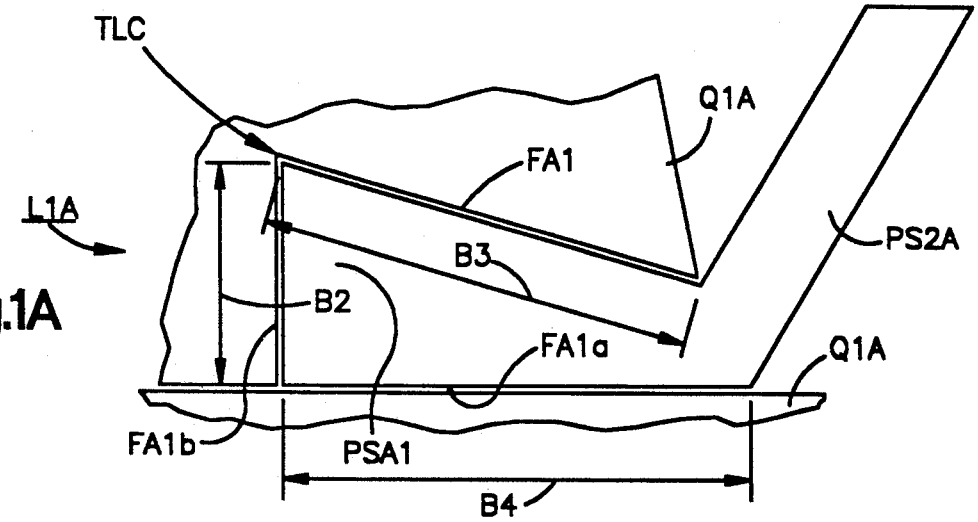
FIGS. 1A to 1C, 2 and 3 show cross-sectional views of different embodiments of longitudinal beams for supporting grid walls.

Accordingly, as shown in FIG. 1A and further below in the FIGS. 8A, 9, 11 and 12 it is possible to use the longitudinal beams as separate building elements for installation with cross beams in the supporting grid.

As shown in FIG. 1 an important feature is the construction of the longitudinal beams with profile legs PS1 and PS2, the first of which forms a bearing surface F1 and the second a retaining surface F2 for the bulk material filling. Most important, the profile leg PS1 has a wedge-shaped, in the example shown a trapezoidal, cross-section with a cross-sectional height H1 which increases evenly from the outside inwards. Compared to the known building elements, this design provides an improved bearing capacity in relation to the mass as well as good securing of the bulk material filling and enhanced root space for vegetation at the exposed bulk material slopes in the front of the wall.

Figure 1B:
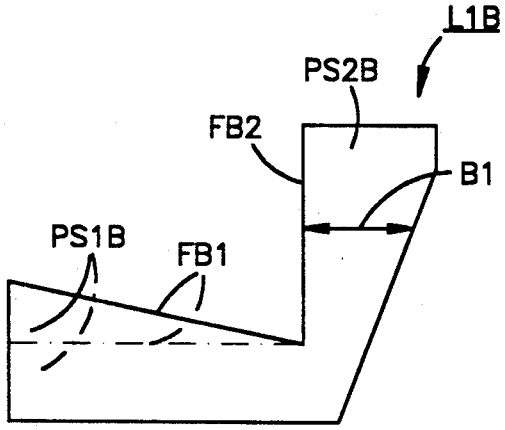
Figure 1C:
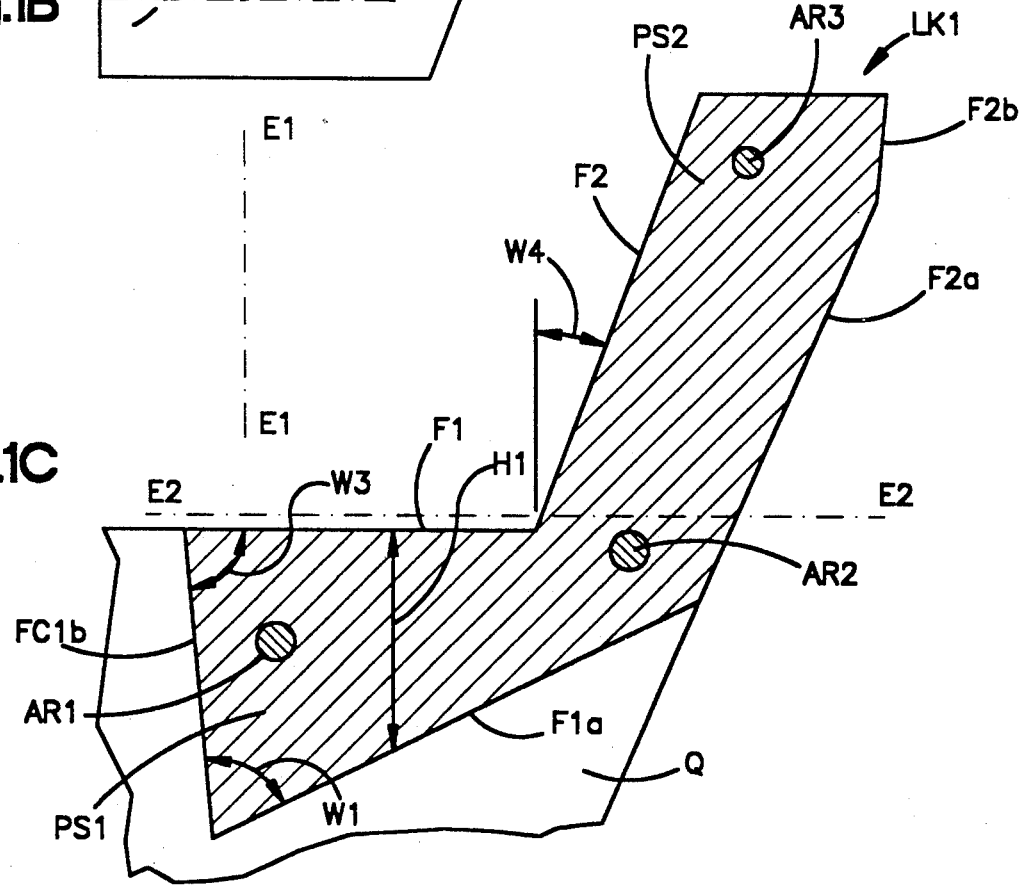

As shown in FIGS. 1, 1A and 1C supporting surfaces F1*b*, FA1*b* and FC1*b* respectively are formed on the insides of the profile legs PS1, PSA1 respectively. These supporting surfaces hold the bulk material located within the inner space of the frame and assist uniform compaction of the filling. In this example, the supporting surfaces are substantially plane and extend over the maximum height of the wedge-shaped cross-section of the first profile leg. Thus, the supporting surfaces form comparatively sharp lower and upper edges with angles W1 and W3 respectively. Due to this the supporting surface serves best in securing the bulk material filling and in preventing the bulk material from excessively sliding into the slope portion between vertically adjacent longitudinal beams.

In this context the width of the supporting surface is important. As visualized in FIG. 1A the width B2 of the supporting surface FA1*b* amounts to more than 35% of the width B3 of the bearing surface, which is a preferred range. According to the embodiment of FIG. 1C as the best mode of operation it is preferred to choose for the width of supporting surface FC1*b* at least 50% of the adjacent bearing surface F1.

As shown in FIGS. 1 and 1A the underside of the first profile legs PS1 and PSA1 form a plane base surface F1*a* and FA1*a* respectively. For the strength of the building element the ratio of the supporting surface width B2 to the base surface width B4 is important. As visualized in FIG. 1A the width B2 of the supporting surface FA1*b* amounts to more than 30% of the width B4 of the base surface FA1*a*, which is preferred range. However, it is preferred to choose for the width of supporting surface FC1*b* at least 50% of the adjacent base surface FA1*a*.

Furthermore, for the bulk material holding and stabilizing effect the angle between the base surface and the supporting surface is important. As shown in FIG. 1C this angle W1 is less than 90°. Best results have been obtained with values of the angle W1 of less than about 80°.

The bulk material generally is compacted in the inner space of the frame-shaped building elements and of the whole grid structure. The bulk material of the slopes formed in the gaps of the wall front also is often compacted by displacing it into the inner space under external pressurizing. In this respect the angle W3 shown in FIG. 1C between the supporting surface FC1*b* and the bearing surface F2 is of importance. Preferably this angle is less than 90°, but for best results preferably less than 85°.

In the manner indicated in FIG. 1C, the cross-section of a longitudinal beam may be provided with reinforcements AR1–AR3 in positions which ensure an optimum increase in strength. Generally the bearing surfaces have a slant adapted to the angle of slope of the bulk material filling in relation to the wall plane E1 and the frame plane E2. In this connection a possible inclination of the former with respect to the vertical must be taken into account, whereas the holding surfaces are arranged more steeply and serve essentially to secure the position of the bulk material filling in the horizontal direction.

As shown in FIG. 1 and 1C the underside of the first profile legs PS1 form a plane base surface F1*a* which, with respect to the frame plane E2, slants downwardly inwardly. This allows for enhanced access of sunshine and rain to the vegetation at the bulk material slopes located beneath such base surface. However, in case depending on the conditions of the specific application this is not a major object, base surfaces extending substantially parallel to the frame plane may be selected also as shown in FIGS. 1A and 1B. This offers certain advantages as to the concrete mass expenses and the design of a form-locking connection between longitudinal and cross beams, particularly in case of selecting an outwardly slanting bulk material bearing surface.

Also of importance is the inclination of the bulk material retaining surface. According to FIGS. 1 and 1C this surface F2 is arranged, with respect to the wall plane E1, slanting downwardly and inwardly in the direction to the inside space of the frame. The slanting angle W4 is preferably between about 0° and about 45°, but in view of best results preferably about 30° at most. However, under certain conditions the retaining surface FB2 may extend without inclination to the wall plane E1 as shown in FIG. 1B.

Furthermore, the embodiment of FIG. 1A shows an outwardly declined slant of the bearing surface FA1. For a variation with merely form-locking connection between longitudinal and cross beams this offers the advantage that the position of the longitudinal beams can be secured against outward dislocation in relation to the cross beams under the effect of the filling pressure by means of recesses of corresponding shape in the cross beams Q1A resting on the longitudinal beams.

The longitudinal beam L1B according to FIG. 1B has enhanced horizontal bending strength of the profile leg PS2B due to the fact that its cross-sectional width B1 increases towards the top so as to form a comparatively broad cross-sectional area of small height. The bearing surface B1 on the profile leg PS1B may, as indicated by dot-dash lines, also be made without a slant.

Further FIG. 1C shows a variation of a building element in which the front side of the profile leg PS2 has two surface sections F2*a*, F2*b* arranged tilted in relation to one another around the longitudinal axis of the beam so as to form an outwardly projecting, obtuse-angled longitudinal edge. Given a certain maximum cross-sectional width at the upper end of the profile leg this results in a more obtuse-angled upper end edge LK1 of diminished sensitivity against damage under rough conditions of use. More than two such surface sections may be provided with advantage. This design may be adopted preferably in case the profile leg in question has a front surface which—by sections or as a whole—slants upwardly and outwardly.

Figure 2:
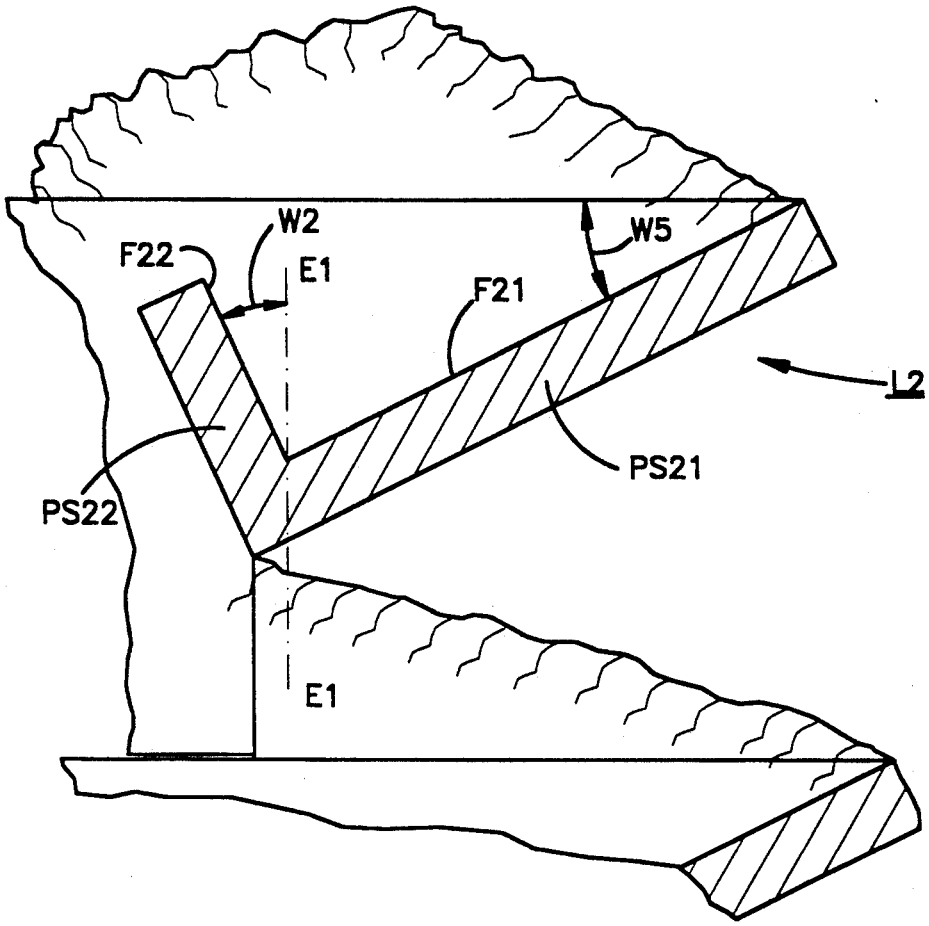

In most of the applications the bulk material bearing surfaces are arranged, with respect to the frame plane, slanting downwardly in the direction to the inside space of the frame, namely as a whole or by sections. The slanting angle 25 shown in FIG. 2 is preferably no more than about 35°, and preferably about 25°.

FIGS. 2 to 5 and 7 to 10 further show embodiments of frame-shaped building elements, in which one or more second profile legs PS22, PS32, PS42, PS52, PS72, PS82, PS92, PS102 and PS103 respectively are arranged offset towards the inside of the frame with respect to bearing surfaces F21, F31, F41, F51, F71, F81 and F101 respectively. Such second profile legs extend upwardly or downwardly from the main body of corresponding first profile legs PS21, PS31, PS41, PS51, PS71, PS81 and PS101 respectively. They also form bulk material retaining surfaces F22, F32, F42, F52, F72, F82, F92 and F102 respectively. The retaining surfaces generally are arranged so as to face the slope bulk material. In this context FIG. 2 specifically shows an inclined arrangement of profile leg PS22 slanting downwardly and outwardly from the inside frame space by an angle W2 to the wall plane E1.

This design has the special advantage that it prevents the filling from sliding in the direction of the inside space of the frame when settlement takes place in the latter region, as well as that of an improved compactability of the filling material in the inside space as a result of the abutment effect of the supporting surfaces. The inside profile legs also easily permit desired separation of the valuable filling material with a high humus content in the planting region from the coarse filling material in the inside space.

Figure 4:
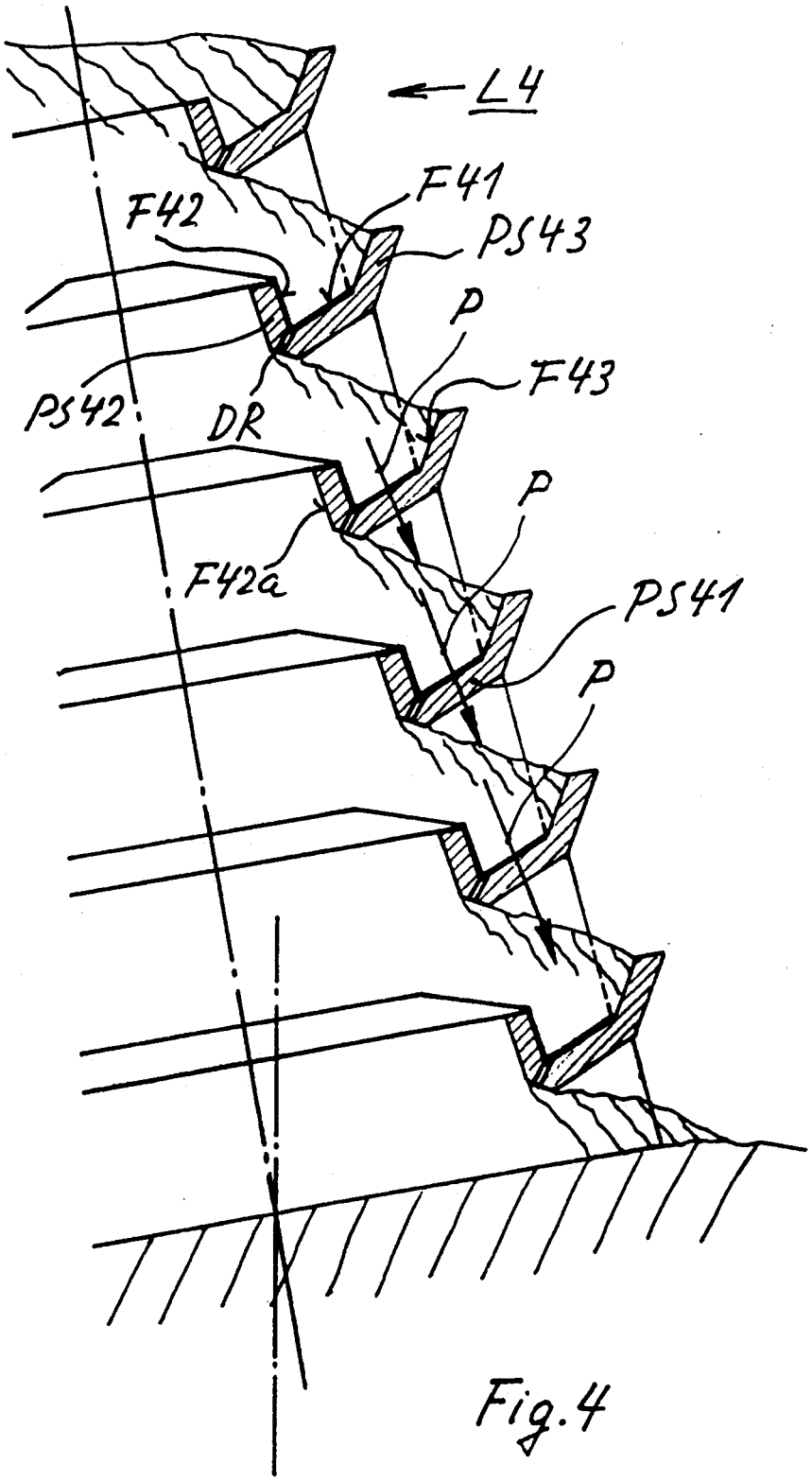
FIG. 4 shows in a vertical cross-sectional view a further construction of a supporting grid wall with bulk material filling.
Figure 5:
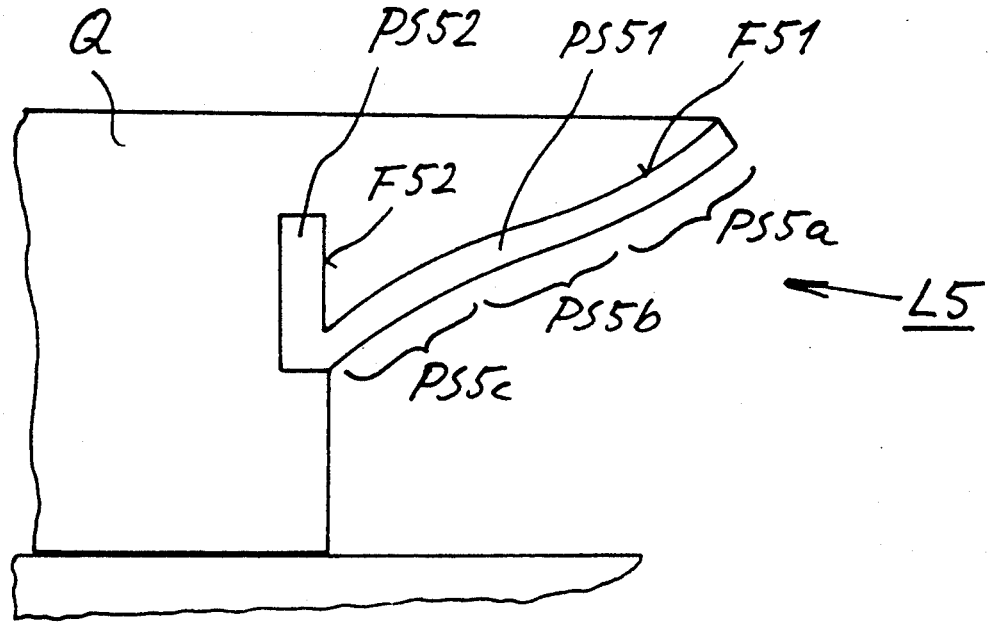
FIGS. 5, 6, 6A, 7, 8, 8A, and 9 to 12 show in cross-sectional views further variations of longitudinal beams for supporting grid walls.

According to FIG. 4 it is possible to combine the advantages of the two constructions with inside and outside profile legs, ensuring a particularly high bending strength with respect to the resultant filling forces P.

Figure 3:
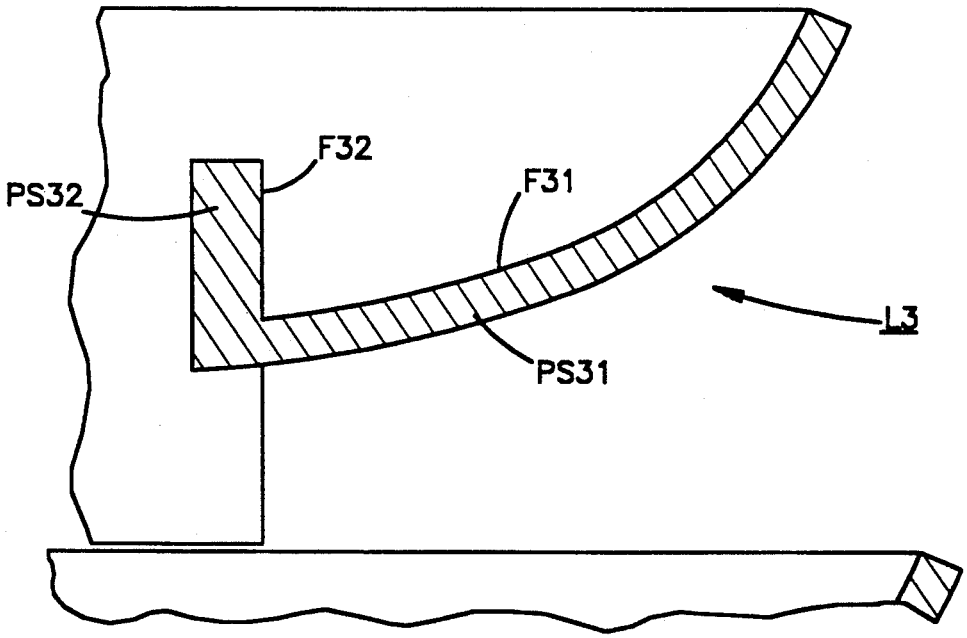
Figure 6:
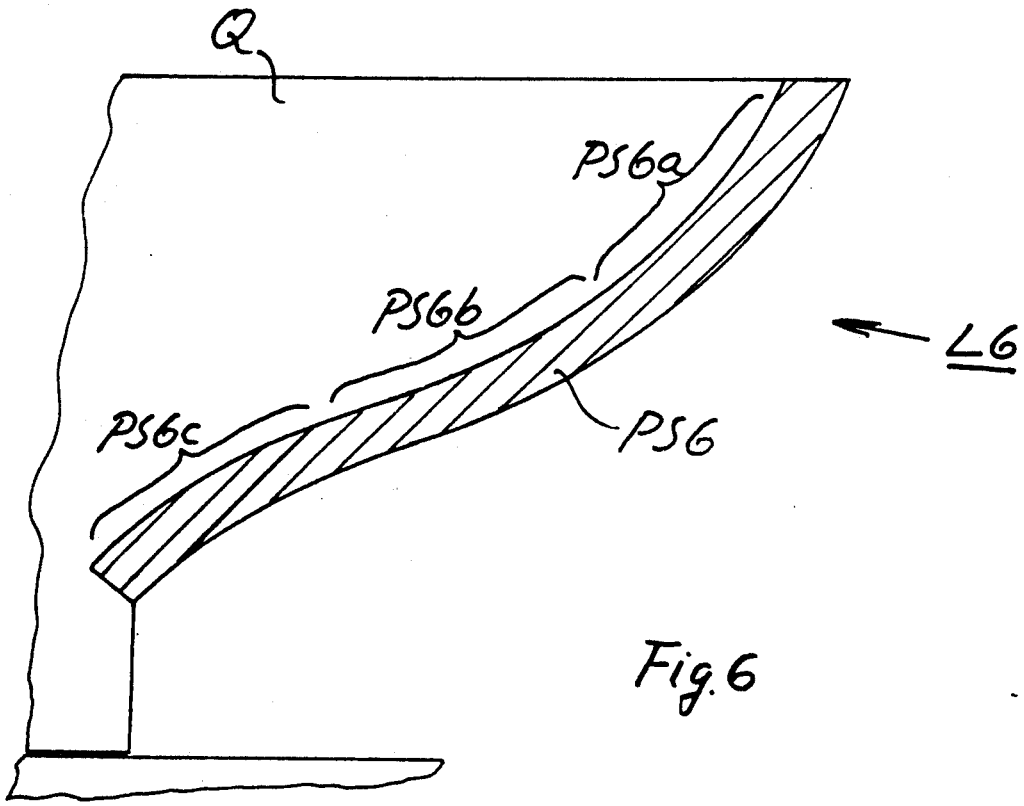
Figure 6A:
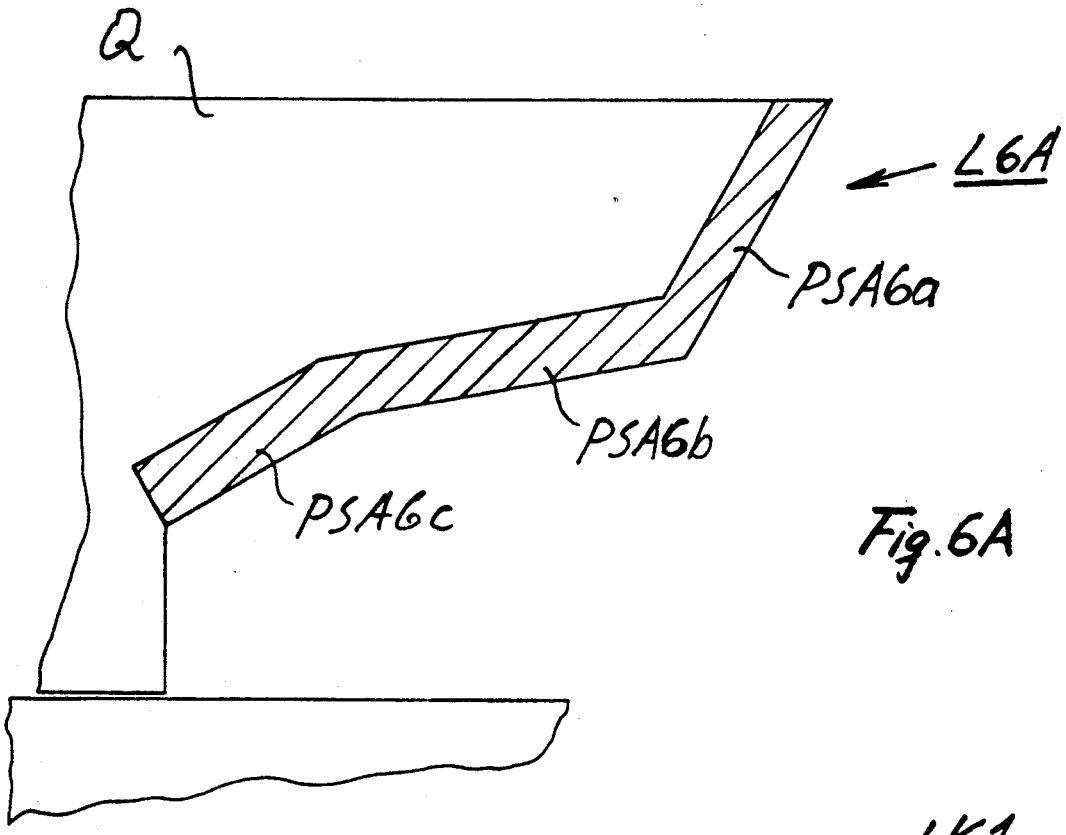
Figure 7:
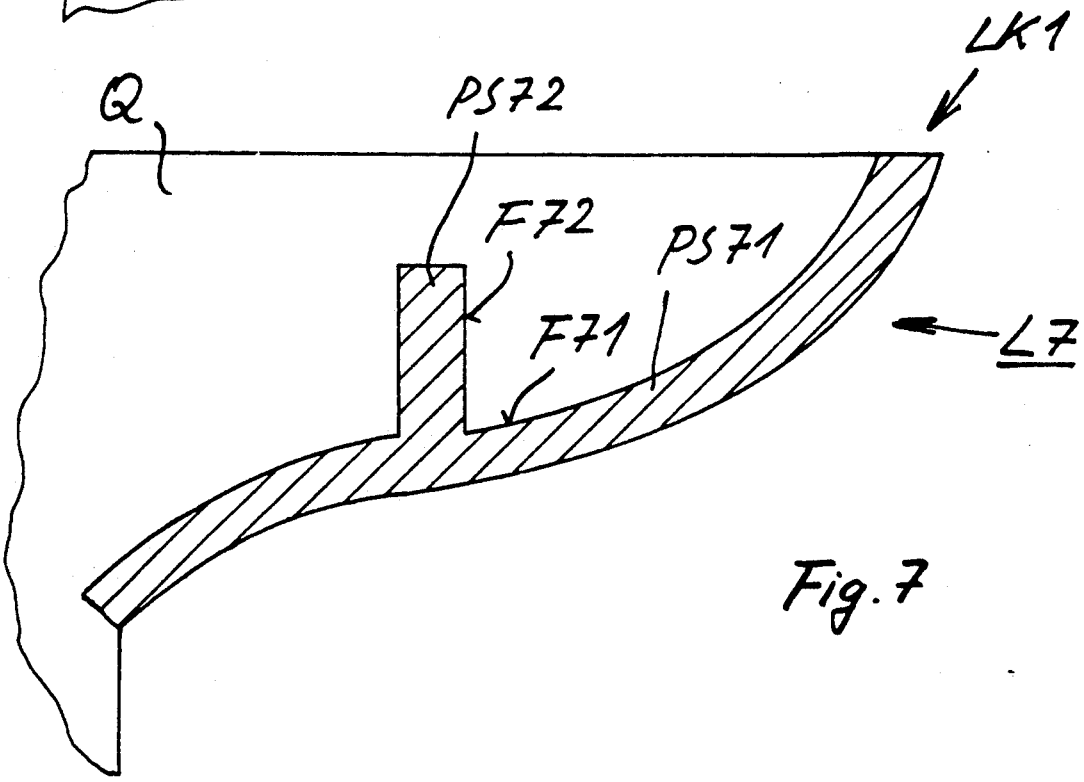

Particularly simple and easy to produce designs are obtained according to the examples illustrated in FIGS. 2 and 3, wherein the concave, generally cylindrical shape of the bearing surface according to FIG. 3 ensures a high bending resistance moment and an increase in the root space whilst providing satisfactory aesthetic appearance of the front of the wall. The latter also applies above all to the embodiments according to FIG. 5, 6 and 7 comprising profile legs or profile leg sections angled alternately in opposite directions and corresponding bearing surface and outside surface sections according to the characteristics of claim 31. According to FIG. 6 and 6A one can, if need be, dispense with special profile legs with retaining or support surfaces when the properties of the filling material and the conditions of use of the structure permit this. The advantage lies in the more simple shape and the fact that they can be produced more easily. With this one generally uses, as indicated in FIG. 6A, a bearing surface for the bulk material filling which has a relatively small slant in relation to the horizontal. FIG. 7, on the other hand, shows a design which is good with regard to strength, the retaining of the filling, the root space and the outer appearance, comprising an upwardly directed rib-shaped leg PS72 formed on in the central region of the profile leg PS71. Particularly advantageous in this connection is also the fact that the curvature of the profile leg PS71—provided as an element having the same thickness all over—increases progressively towards the free longitudinal edge LK1, as indicated in claim 22.

Figure 8:
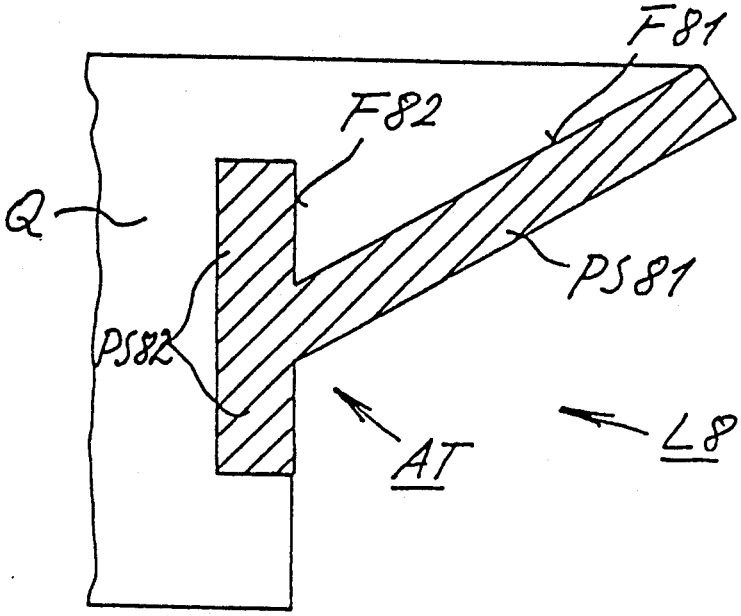
Figure 8A:
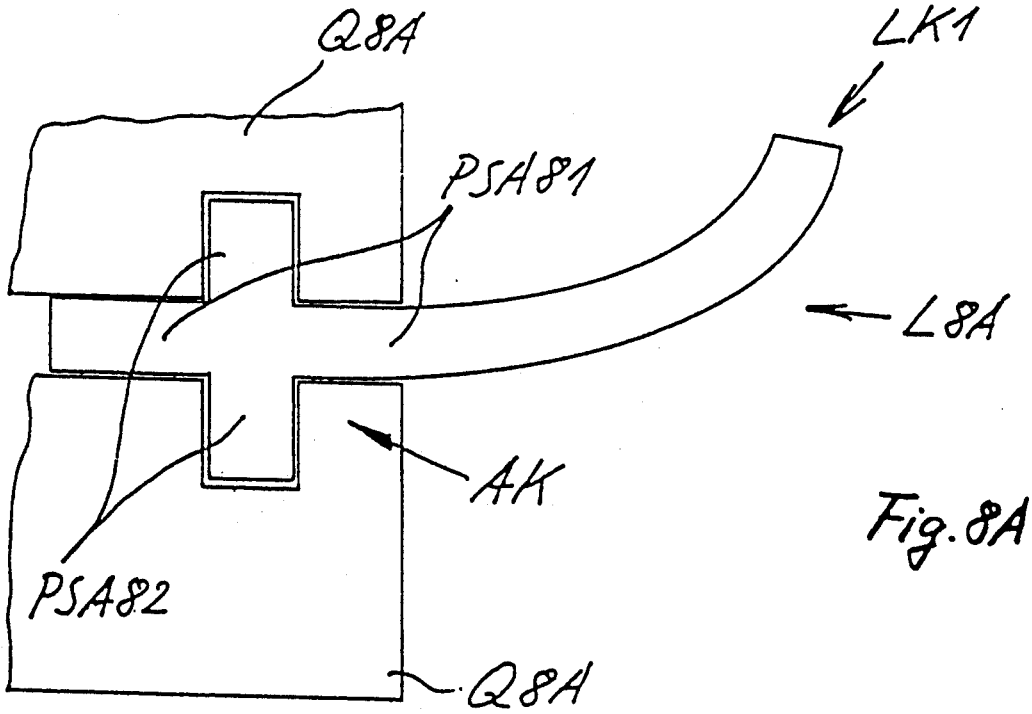
Figure 9:
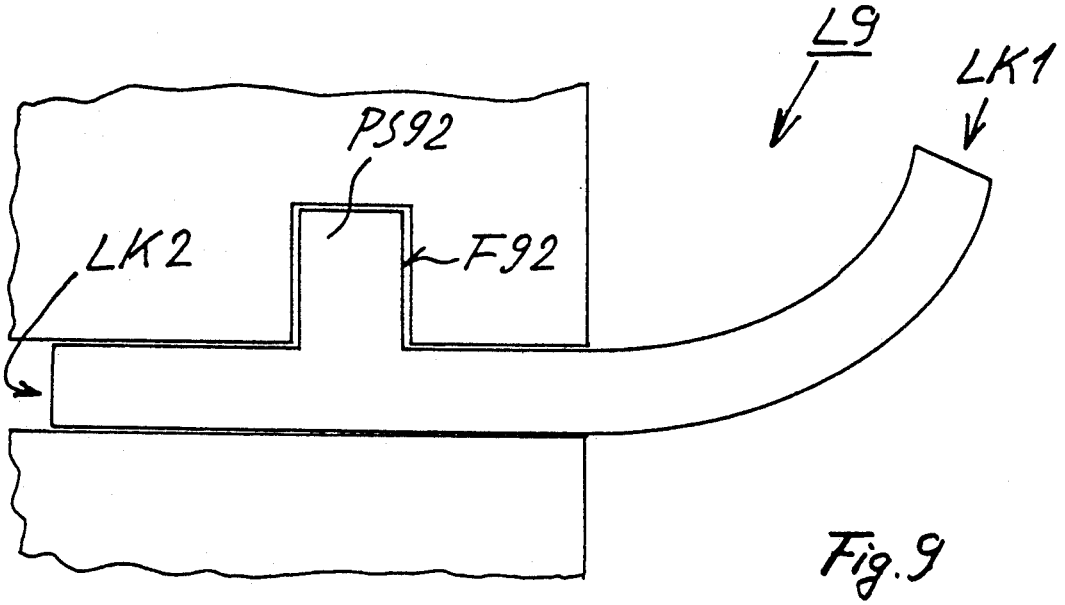
Figure 10:
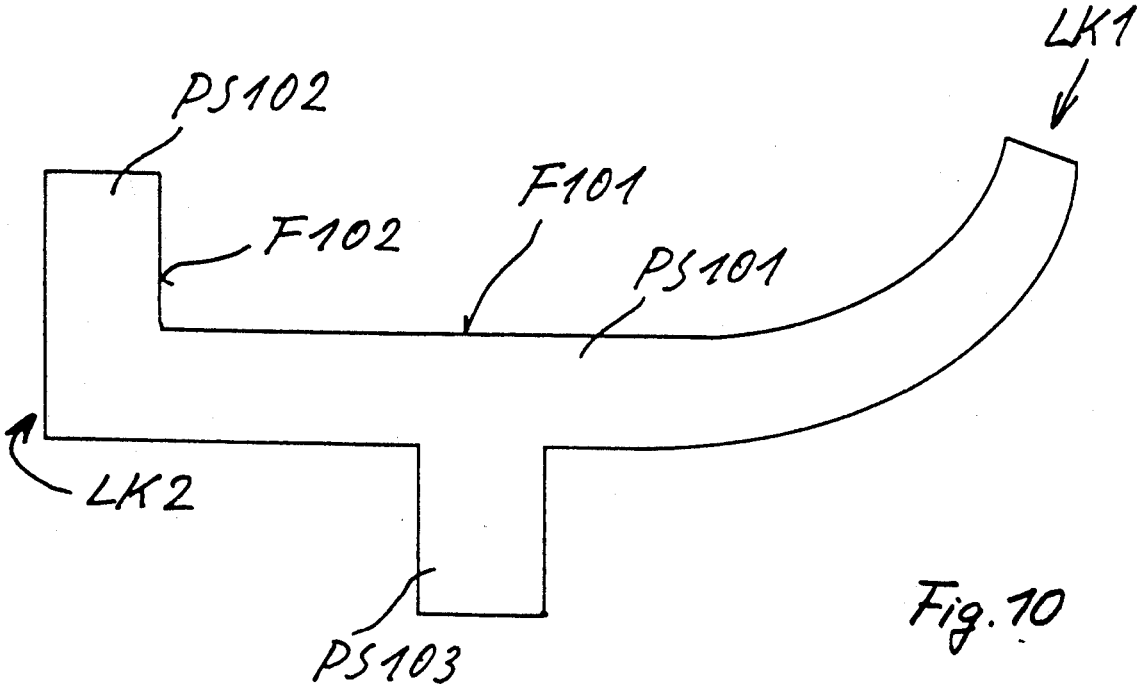

The embodiment according to FIG. 8 is characterised by a simple shape whilst ensuring a high bending strength as a result of a T-shaped profile cross-sectional area AT with aligned profile legs PS82, as indicated in claim 33. The embodiment according to FIG. 8A displays a cross-shaped profile section with an even greater increase in the strength of the beam. In addition this embodiment is particularly suitable for the separate installation of the longitudinal beam L8A in the supporting grid, with form-locking securing of its position by the cross beam Q8A which is provided with recesses corresponding to the opposite profile legs PSA82.

The embodiments according to FIG. 8A to 10 comprise rib profile legs PSA82, PS92 and PS103 respectively, formed transversely onto a first bearing surface profile leg, and arranged at a distance from the two longitudinal end edges LK1 and LK2 of the beam. All these embodiments have good bending strength, the ease of providing vegetation, and a simple securing of their position when installed separately, as explained in connection with FIG. 8A.

Figure 11:
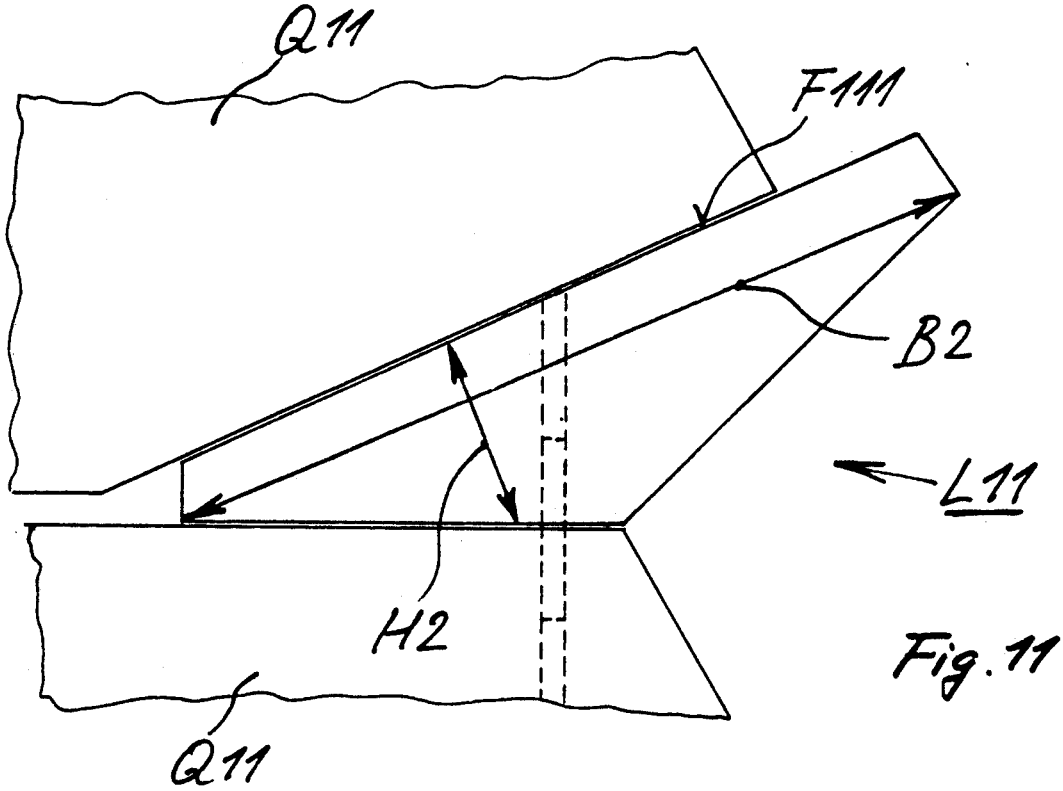
Figure 12:
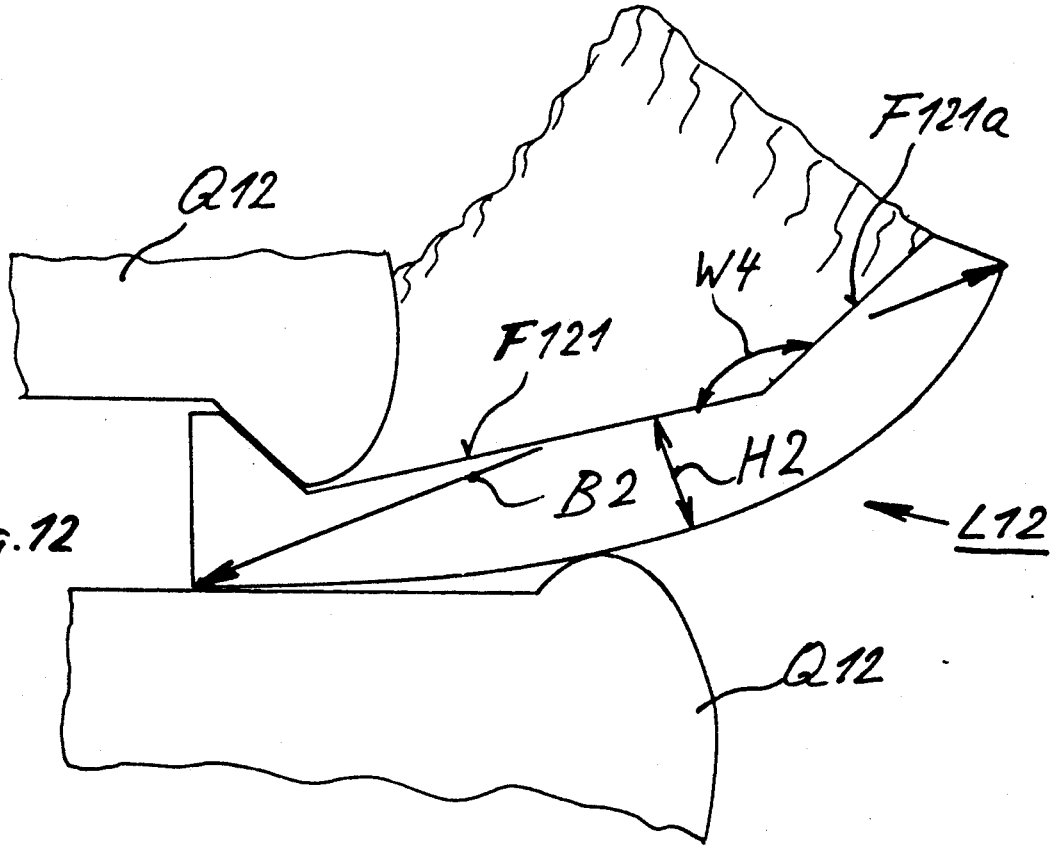

The characteristics of claims 35 to 39 are illustrated in the embodiments according to FIG. 11 and 12. These are very simple and compact, as well as easy to produce cross-sectional shapes of the longitudinal beams L11 and L12, in the first case, however, at the expense of the root space, but with a particularly high bending strength. The securing of their position when installed separately as shown in FIG. 11 is ensured by the indicated anchoring pins in vertical recesses of the cross beam Q11 and the longitudinal beam L11. The construction according to FIG. 12 manages without such anchoring pins, seeing that ribs and beads provided on the beams result in a form-locking horizontal and vertical securing. The measures indicated in claim 35 and above all in claim 36 result in shaping of the longitudinal beam approximately as a bending beam subjected to the same bending stress over the entire cross-sectional width under the weight of the bulk material filling lying on the bearing surfaces. In this connection the characteristics of claims 38 and 39 also permit a relatively large root space. The installation in the supporting grid is advantageously simple.

Figure 13:
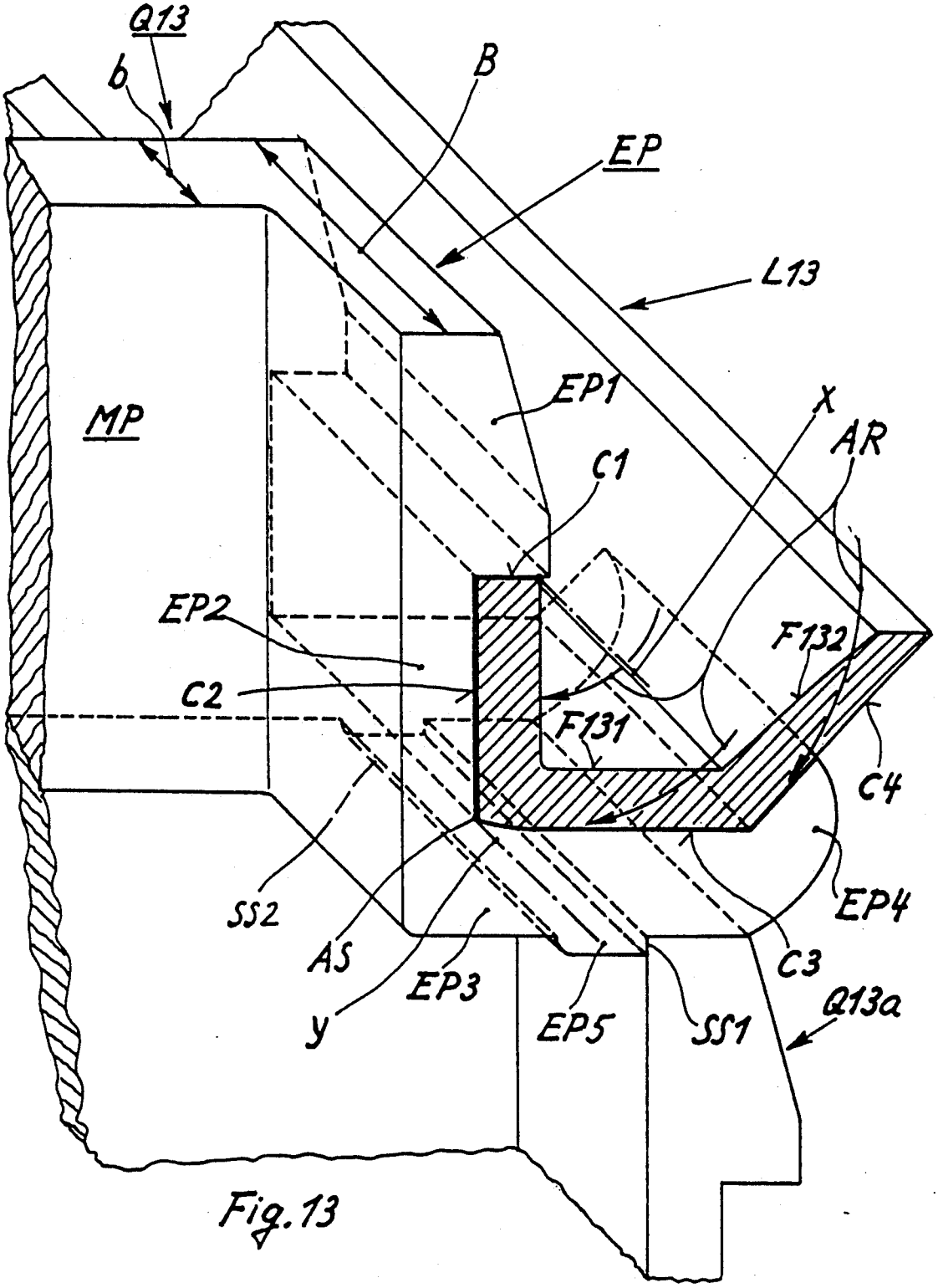
FIG. 13 shows in a perspective view a part of the grid structure of a supporting wall comprising a connection structure between a longitudinal and a cross beam.

A further embodiment of a multi-part building element according to the invention is shown in FIG. 13 in a perspective partial view, i.e. in a view on the region of connection between an end portion of a cross beam Q13 and a longitudinal beam L13. The cross beam Q13 comprises a middle portion MP (partially shown in FIG. 13) of smaller cross-sectional breadth b and an end portion EP of greater cross-sectional breadth B. End portion EP is shaped to form a recess or hole AS, which is open over a portion of its circumference for receiving the longitudinal beam L13 and to form a form-locking connection therewith. For this purpose the contour of recess AS is adapted to a corresponding part of the cross-sectional contour of the longitudinal beam L13, i.e. in the example to the contour sections C1, C2, C3 and to the lower part of section C4. The end portion EP of the longitudinal beam L13 accordingly comprises an upper locking portion EP1 overlapping the contour section C1 and a support portion EP3 extending below the contour section C3 so as to secure the longitudinal beam L13 against tilting in clockwise direction about its longitudinal axis y (with reference to the view of FIG. 13) under the weight of the bulk filling resting on the bearing surfaces F131 and F132. Furthermore, holding portions EP2 and EP4 cooperating with contour sections C2 and C4 are provided to secure beam L13 against horizontal displacement. At the lower surface of end portion EP a further locking portion EP5 is provided in the form of a projecting rib extending in the longitudinal direction y of beam L13 and cooperating with correspondingly shaped surface sections SS1 and SS2 of a further cross beam Q13*a* located below and bearing the cross beam Q13, the latter thus being also secured against horizontal displacement and rotation.

Moreover, it is essential that the contour of recess AS is shaped in such a manner that the longitudinal beam L13 can be swung into its form-locking seat in the recess AS by firstly abutting against locking portion EP1 with its contour section C1 in a position rotated somewhat in relation to the position shown in FIG. 13 in the anticlockwise direction, and then being rotated in the clockwise direction according to arrows AR about axis X formed by the abutment between contour section C1 and locking portion EP1. This is a highly simple and comfortable method of mounting the longitudinal beam on the cross beam and leads to a fully form-locking connection between both beams against all displacements and rotations, except only a displacement of the longitudinal beam in its longitudinal direction and a re-rotation about axis X in the anticlockwise direction, both these movements in relation to the cross beam being without relevance in the mounted state due to the action of the weight of the longitudinal beam and of the bulk filling resting thereon.

Furthermore, the provision of an end portion EP of comparatively great breadth B on the cross beam Q13 leads to an enhanced form-locking stability in the connection between both beams against bending and torsion moments. In this respect even a favourable approximation to the conditions of a material-locking or unitary connection between the beams can be obtained. In this context it is further of essential importance that the enhanced connection stability is obtained without inproportioned mass and weight as well as expenses for the middle portion of the cross beam, this advantage being due to the relation of breadths b and B in the cross beam portions MP and EP as explained above. In view of the production expenses it is of great importance to have the over-all contour surfaces of cross beam Q13 shaped prismatic, i.e. substantially in parallel to axis y, including the surfaces of recess AS. This shape makes it possible to readily mould the cross beam from concrete or similar materials including a suitable armature by casting or pressing the material into a simple and preferably undivided and/or open mould. On principle these advantages are obtainable with closed recess shapes also, in which a longitudinal beam has to be shifted-in for mounting.

I claim:

1. A supporting grid wall for a bulk material filling defining a generally vertically extending wall plane and a frame plane extending transversely thereto, comprising at least two beams arranged at an angle to one another and connected in a form-locking or material-locking manner, one of said beams being a longitudinal beam extending substantially parallel to the wall plane and comprising at least two profile legs arranged at an angle to one another, said first profile leg having at least one bearing surface for the bulk material filling covering substantially the central part of the longitudinal beam's cross-section, and said second profile leg having a retaining surface for the bulk material filling facing the inside space of the frame, offset to and disposed at an angle to the outside of the frame with respect to the bearing surface for the bulk material filling, characterized in that said first profile leg has a wedge-shaped cross-section with a cross-sectional height which increases evenly from the outside inwards.

2. A wall according to claim 1, characterized in that the underside of the first profile leg has a general planar base surface which, with respect to the frame plane, slants down inwardly, said first profile leg on its side facing the inside space of the frame having at least one supporting surface for the bulk material filling arranged at an angle to said bearing surface and said base surface.

3. A wall according to claim 2, characterized in that the angle between the base surface and the supporting surface is less than 90°.

4. A wall according to claim 3, the angle between the base surface and the supporting surface is less than about 80°.

5. A wall according to claim 2, characterized in that the width of the supporting surface is at least about 30% of the width of the base surface.

6. A wall according to claim 5, wherein the width of the supporting surface is at least 45% of the width of the base surface.

7. A wall according claim 1, characterized in that the bearing surface of the first profile leg with respect to the frame plane slants downwardly and outwardly in the direction of the inside space of the frame.

8. A wall according to claim 7, characterized in that the base surface of the first profile leg extends generally parallel to the frame plane.

9. A wall according to claim 1, characterized in that the second profile leg has a cross-sectional width which, over at least part of its cross-sectional height, increases in a direction from the first profile leg upwardly.

10. A wall according to claim 9, characterized in that the front side of the second profile leg has at least two surface sections arranged tilted in relation to one another around the longitudinal axis of the beam, said surface sections together forming an outwardly projecting, obtuse-angled longitudinal edge.

11. A wall according to claim 10, characterized in that the front side of the second profile leg has a first surface section which, with respect to the wall plane, slants upwardly and outwardly, and a second surface section which extends upwardly from said first surface section to said top longitudinal end edge and which, with respect to said first surface section, is arranged tilted around the longitudinal axis of the beam in the direction of the inside space of the frame.

12. A frame for a planar supporting grid wall having a bulk material filling, comprising at least two beams arranged at an angle to one another and connected in a form-locking or material-locking manner, one of said beams comprising a longitudinal beam extending substantially parallel to the plane of said wall and having two profile legs arranged at an angle to one another, a first one of said profile legs having a one bearing surface for the bulk material filling covering substantially the central part of said longitudinal beam's cross-section, and a second one of said profile legs forming a retaining surface for the bulk material filling facing inwardly of said frame and spaced outwardly from said bearing surface for the bulk material filling, said retaining surface being disposed at an angle to said bearing surface, said first profile leg having a wedge-shaped cross-section and a substantially planar bottom surface forming the underside of said wedge-like cross-section, said bearing surface forming the upper side of said first profile leg and being also substantially planar whereby the cross-sectional height of said first profile leg increases evenly in a direction from the outside of said frame inwards.

13. A building element according to claim 12, wherein said first profile leg has a side surface facing inwardly of said frame and forming a substantially planar supporting surface for the bulk material filling, said substantially planar supporting surface extending for the maximum height of said wedge-shaped cross-section of said first profile leg.

* * * * *